US005996708A

United States Patent [19]

Gerold

[11] Patent Number: 5,996,708

[45] Date of Patent: Dec. 7, 1999

[54] PERCUSSION TOOL

[75] Inventor: Peter Gerold, Weilheim, Germany

[73] Assignee: Hilti Aktiengesellschaft, Schaan, Liechtenstein

[21] Appl. No.: 09/111,262

[22] Filed: Jul. 6, 1998

[30] Foreign Application Priority Data

Jul. 4, 1997 [DE] Germany ..... 297 11 704

[51] Int. Cl.[6] ..... B25D 17/11

[52] U.S. Cl. ..... 173/211; 173/133; 173/162.1; 173/200

[58] Field of Search ..... 173/210, 211, 173/162.1, DIG. 2, 48, 109, 200, 162.2, 133; 267/137

[56] References Cited

U.S. PATENT DOCUMENTS

| | | | |
|---|---|---|---|
| 2,035,643 | 3/1936 | Douglass et al. | 173/162.2 |
| 3,266,581 | 8/1966 | Cooley et al. | 173/162.1 |
| 3,625,295 | 12/1971 | Gunning | 173/DIG. 2 |
| 4,476,941 | 10/1984 | Buck et al. | 173/133 |
| 4,653,596 | 3/1987 | Kostylev et al. | 173/210 |
| 4,719,976 | 1/1988 | Bleicher et al. | 173/109 |
| 4,732,217 | 3/1988 | Bleicher et al. | 173/109 |
| 5,050,687 | 9/1991 | Prokhorov et al. | 173/210 |
| 5,099,926 | 3/1992 | Fushiya et al. | 173/200 |
| 5,363,835 | 11/1994 | Robson | 173/162.1 |
| 5,407,018 | 4/1995 | Henry | 173/162.1 |
| 5,775,441 | 7/1998 | Sakuragi et al. | 173/200 |
| 5,871,059 | 2/1999 | Shibata et al. | 173/211 |

*Primary Examiner*—Peter Vo
*Assistant Examiner*—Jim Calve
*Attorney, Agent, or Firm*—Brown & Wood, LLP

[57] ABSTRACT

A percussion tool, such as a drill or a chisel tool, including a percussion mechanism (7), a tool chuck (1), and a damping member (8) arranged between the tool chuck (1) and the percussion mechanism (7) for damping rebounds of a header (9) axially displaceable in the tool chuck (1), with the damping member (8) having, arranged one after another in the operational direction, a stop disc (86), an elastic ring (83), and a transmission element (81) having a cavity for receiving both the stop disc (86) an the elastic ring (86).

5 Claims, 3 Drawing Sheets

PERCUSSION TOOL

BACKGROUND OF THE INVENTION

1. Filed of the Invention

The present invention relates to a percussion tool, such as a hand-held drill or a chisel tool, and including a header displaceable in the tool chuck, a damping member for damping rebounds of the header and cooperating with a stop surface which is provided at a rear, with respect to the operational direction of the percussion tool, end of the header, with the damping member including arranged one after another a stop disc, an elastic ring and a transmission element, and a percussion mechanism including a guide cylinder defining a stop for the damping member.

2. Description of the Prior Art

German document DE-OS 41 35 240 discloses a percussion tool such as a drill or a chisel tool having a percussion mechanism with a guide cylinder and a tool chuck. The guide cylinder receives a percussion piston, which is driven by a swash plate mechanism, and a float piston driven by the percussion piston. An axially displaceable header is located in central bore of the chuck in its rear, with respect to an operational direction, end region. During the operation of the percussion tool, the header cooperates with a shank of a tool inserted in the tool chuck at the front end surface of the chuck. The portion of the header remote from the tool shank has a cylindrical cross-section and a reduced diameter. The rear cylindrical portion of the header extends through a damping member provided between a stop, which is formed on the guide cylinder of the percussion mechanism, and the stop shoulder formed at the rear end of the header. The damping member serves for damping rebounds of the header and is formed of a stop disc cooperating with the header, a transmission element supported against a stop provided on the guide cylinder of the percussion mechanism, and an elastic ring arranged between the stop disc and the transmission element. The stop on the guide cylinder is formed by a locking element formed as a snap ring which projects into an annular indentation formed on the inner side of the guide cylinder.

A serious drawback of the prior art percussion tool consists in difficulties associated with mounting of the damping member because all elements of the damping member need be separately installed in the guide cylinder and aligned there.

The subsequent insertion and fixing of the snap ring with an appropriate tool requires a lot of skill and a high concentration from a worker. Because the mounting of the damping member is very labor-consuming, it requires a lot of time.

Accordingly, an object of the present invention is to provide a percussion tool such as a drill or a chisel tool in which mounting and dismounting of the damping member can be effected rapidly, simply and economically.

SUMMARY OF THE INVENTION

This and other objects of the present invention, which will become apparent hereinafter, are achieved by providing a damping member the transmission element of which has a cavity for receiving both the stop disc and the elastic ring. By arranging both these elements in the receiving cavity of the transmission member, an easy mounting of the damping member, which is formed as a unit, is achieved. This is because instead of three separate elements, a single unit can be inserted in the guide cylinder.

The transmission element of the damping member serves for receiving and a subsequent large-surface transmission of the rebound energy, which is generated by the header, to the elastic ring. In order to insure this transmission, the stop disc, which cooperates with the header, is supported in the receiving cavity of the transmission element with a possibility of a limited axial displacement.

The spring characteristic of the damping member can be favorably influenced by mounting the elastic ring in the receiving cavity of the transmission element with a preload. In this way, already at the beginning of the axial compression of the elastic ring, an increased damping force is available. For manufacturing reason, advantageously, the limiting of the axial displacement of the stop disc and securing of the elastic ring is effected with a locking element which form-lockingly cooperates with the transmission element. The mounting and securing of the stop disc and the elastic ring in the receiving cavity of the transmission element can be effected outside of the hand-held tool, so that the damping member can be inserted in the percussion tool as a unit.

Advantageously, the locking element is formed as a snap ring which projects into an annular indentation formed in the receiving cavity of the transmission element. Here, e.g., commercially available snap rings can be used. For manufacturing reasons, the transmission element is formed as a pot-shaped element the inner wall of which limit the receiving cavity. The advantage of mounting of the stop disc and the elastic ring inside the receiving cavity of the transmission element consists in that the elastic ring, which is formed, e.g., of rubber, is protected inside of the percussion tool. Thereby, oil and grease, which during the operation of the percussion tool can be transmitted into the front end region of the guide cylinder by movable parts and which can destroy the elastic ring, is kept away from the elastic ring.

In order to insure guiding of the stop disc and the elastic ring over their circumference, advantageously, the outer diameter of both the stop disc and the elastic ring substantially corresponds to the inner diameter of the receiving cavity. In the region of the elastic ring, the receiving cavity can have a somewhat larger diameter to provide for expansion of the elastic ring in the radial direction when the elastic ring is axially loaded during the rebounds of the header.

A good damping of the header with the damping member is achieved when the elastic ring is compressed in a direction parallel to the operational direction and has good elastic deformation characteristics in the radial direction. To this end, the elastic ring is formed preferably with a substantially elliptical cross-section with the larger diameter extending substantially parallel to the operational direction.

During the operation of the percussion tool, at each rebound of the header, an axial displacement of the stop disc, in a direction opposite to the operational direction, takes place in the receiving cavity. In order to prevent bouncing of or an ejection of the snap ring from its annular indentation, there is provided, in front of the stop disc, a guide region the outer diameter of which substantially corresponds to the inner diameter of the snap ring which projects into the annular indentation. The axial or longitudinal extent of the guide region is greater than the width of the snap ring measured in a direction parallel to the operational direction.

A coaxial alignment of the stop disc with the annular stop surface of the header, which tapers in a direction opposite to the operational direction, during a joint rebound of the two parts is achieved by providing, at the front end surface of the stop disc, a conical, extending at least partially circumferentially, stop shoulder which likewise tapers in a direction opposite to the operational direction.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1:
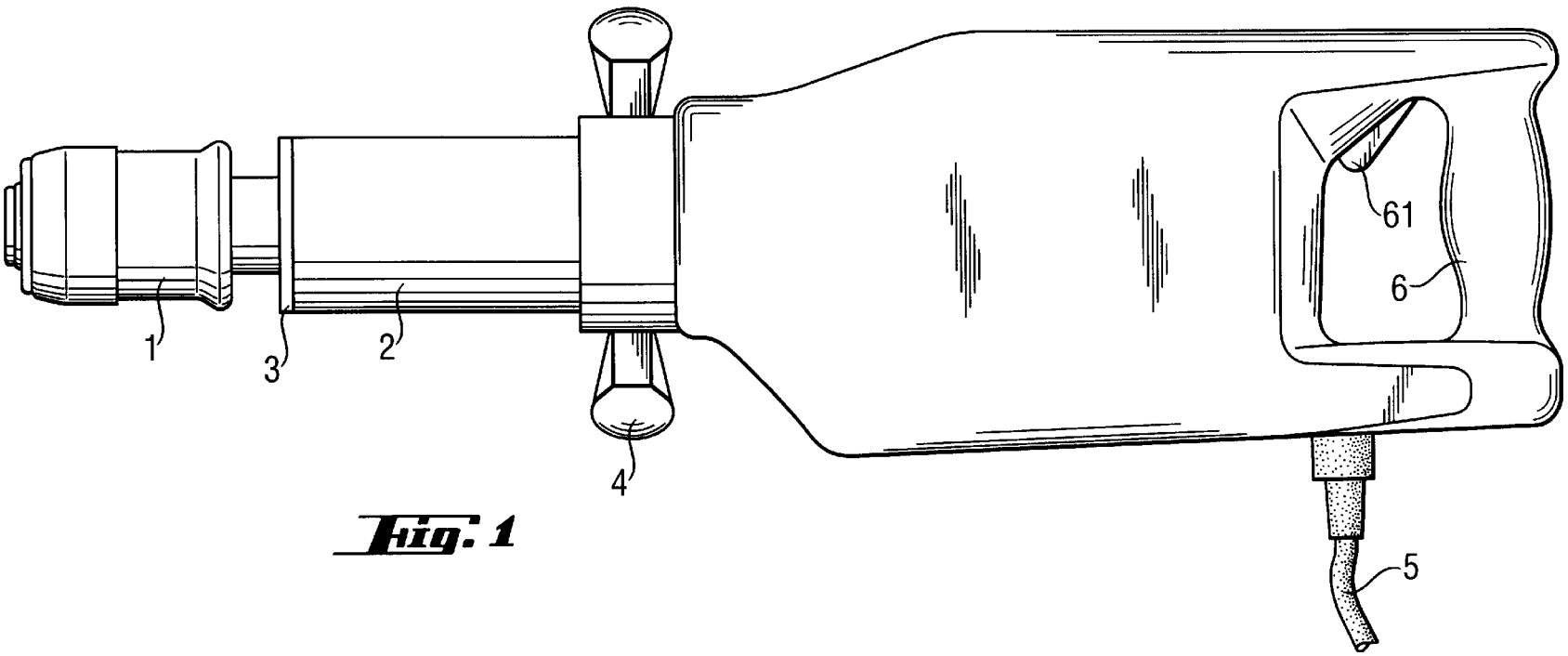
FIG. 1 shows a schematic view of a percussion tool according to the present invention.

A percussion tool according to the present invention such as a drill or a chisel tool, which is shown in FIG. 1, has a housing 2 at a rear, with respect to an operational direction, end region of which there are provided a handle 6 and a trigger 61. An electric cable 5, which extends substantially transverse to the housing 2, projects into a region of the housing 2 located immediately adjacent to the handle 6 and connects a tool motor, which is located in the housing 2, with an external power source upon actuation of the trigger 61. In the front, with respect to the operation direction, region of the tool, there is provided a tool chuck 1 for receiving a drilling or chisel tool (not shown). The tool chuck 1 is connected with the housing 2 by a flange 3. The flange 3 is connected with the housing 2 by several screws (not shown in the drawings). A side handle 4 is located between the tool chuck 1 and the handle 6. The handle 4 is secured to a cylindrical region of the housing 2 and projects sidewise therefrom.

Figure 2:
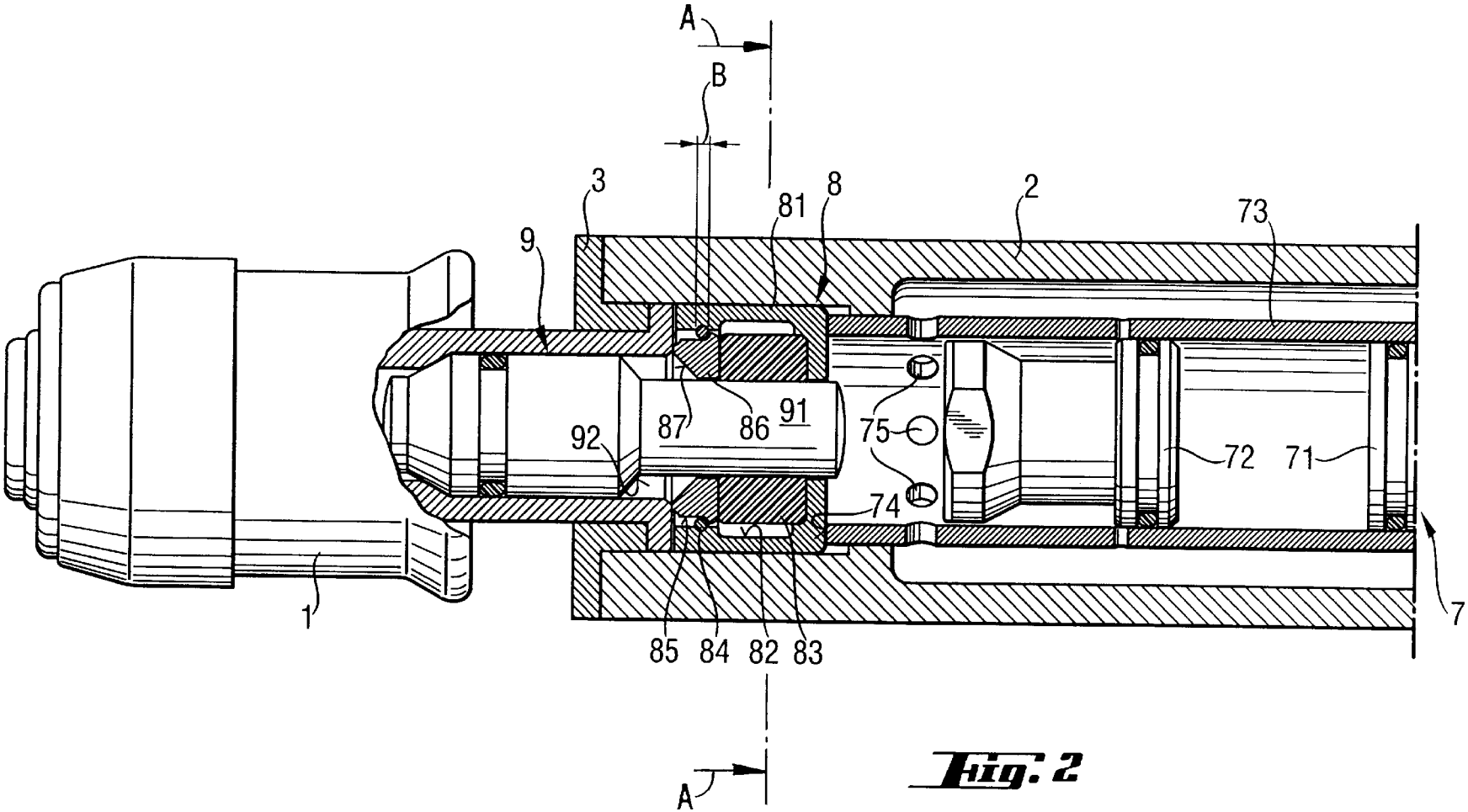
FIG. 2 shows, at an increased scale, a partially cross-sectional view of a front region of the tool shown in FIG. 1.

As shown in FIG. 2, the tool chuck 1 has, at a rear, with respect to the operational direction, end region thereof, a central bore in which a header 9 is axially displaceable. At its rear free end, the tool chuck 1 has an annular surface which provides for axial connection of the tool chuck 1 with the housing 2 by the flange 3 which is fixedly connected with the housing 2 by screws, as discussed above.

Figure 3:
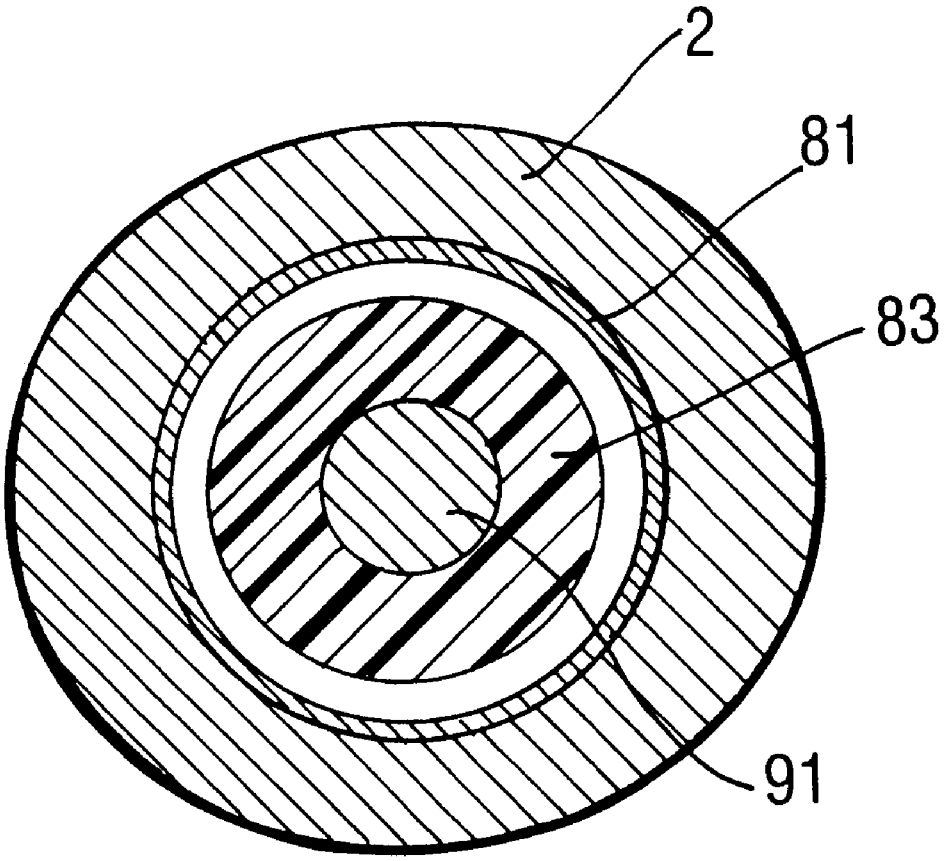
FIG. 3 shows a cross-sectional view along line 3—3 in FIG. 2.

A damping member 8 adjoins the rear end region of the tool chuck 1. The header 9 has, at its rear end a cylindrical, reduced diameter portion 91 which extends through the damping member 8. The damping member 8 serves for damping the rebounds of the header 9 and is formed of a pot-shaped transmission element 81 having a receiving cavity in which a stop disc 86 is located. The stop disc 86 is supported in the receiving cavity of the transmission element 81 for a limited axial displacement therein. An elastic ring 83 is located in the receiving cavity of the transmission element 81 between the stop disc 86 and a rear wall of the transmission element 81. The elastic ring 83 has a substantially elliptical cross-section, with the larger diameter of the elastic ring 83 extending parallel to the operational direction as shown in FIG. 3. The transmission element 81 has a side wall 82 which limits the receiving cavity. The outer diameter of both the stop disc 86 and the elastic ring 83 substantially corresponds to the inner diameter of the receiving cavity. The receiving cavity of the transmission member 81 has a greater diameter in the region in which the elastic ring 83 is received. The greater diameter of the receiving cavity in the region where the elastic ring is received, provides for radial deformation of the elastic ring 83 upon application of an axial load thereto.

The stop disc 86 and the elastic ring 83 are secured in the receiving cavity of the transmission member 81 with a locking element such as a snap ring 84. At that, the elastic ring 83 can be, e.g., preloaded. The snap ring 84 projects into a annular indentation formed in the side wall 82 of the transmission element 81, which is formed in the front end of the transmission member 81. The stop disc 86 and the inner wall 82 define together a guide region 85 the diameter of which corresponds to the inner diameter of the snap ring 84 and an axial extension of which is greater than a width B of the snap ring 84. The guide region prevents bouncing of or ejection of the snap ring 84 out of the indentation formed in the side wall 82. The elastic ring 83 is formed of an elastic material such as, e.g., rubber.

The stop disc 86 has, at its front end, a conical, at least partially circumferentially extending, stop shoulder 87 which widens in the operational direction and which cooperates with a stop shoulder 92 of the header 9.

The damping member 8 is located in the front cylindrical region of a central bore of the housing 2 and is supported against a stop 74 which is formed by a front end surface of a guide cylinder 73. The guide cylinder 73 forms part of a percussion mechanism 7, which is not shown completely in the drawing. The drawing also shows a percussion piston 71 and a float piston 72 of the percussion mechanism 7. The damping member 8 can also be located, with a possibility of axial displacement, in a cylindrical front receiving region of the guide cylinder 73 when the guide cylinder 73 is likewise supported in the housing 2 with a possibility of axial displacement. The guide cylinder 73 has a plurality of through-openings 75 formed in its wall which serve for aeration of the percussion mechanism 7 during operation of the tool.

Though the present invention was shown and described with references to the preferred embodiments, various modifications thereof will be apparent to those skilled in the art and, therefore, it is not intended that the invention be limited to the disclosed embodiments or details thereof, an departure can be made therefrom within the spirit and scope of the appended claims.

What is claimed is:

1. A percussion tool, comprising a tool chuck (1) including a header (9) displaceable in the tool chuck (1); a percussion mechanism for impacting the header (9) and including a guide cylinder (73); and a damping member (8) for damping rebounds of the header (9) and cooperating with a stop surface (92) which is provided between a rear, with respect to an operational direction of the percussion tool, end of the header (9) and a stop (74) defined by the guide cylinder (73) of the percussion mechanism, the damping member (8) including a stop disc (86), an elastic ring (83) arranged, in a direction opposite to the operational direction of the percussion tool, after the stop disc (86), and a transmission element (81) having a cavity for completely receiving both the stop disc (86) and the elastic ring (83), wherein the stop disc (86) is supported in the receiving cavity of the transmission element, (81) for a limited axial displacement therein, wherein the transmission element (81) comprises means for preloading the elastic ring (83) in the receiving cavity, wherein the preloading means comprises a locking member (84) form-lockingly cooperating with the transmission element (81), the locking member (84) limiting the axial displacement of the stop disc (86);

wherein the locking member is formed as a snap ring projecting into an annular indentation formed in the receiving cavity of the transmission member (81), and wherein the stop disc (86) defines, at a front end of the damping member (8) a guide region (85) having an outer diameter, which substantially corresponds to an inner diameter of the snap ring, and an axial extension greater than a width (B) of the snap ring measured in the operational direction.

2. A percussion tool according to claim 1, wherein the transmission element (81) is formed as a pot-shaped member an inner wall (82) of which limits the receiving cavity.

3. A percussion tool according to claim 2, wherein an outer diameter of both the stop disc (86) and the elastic ring (83) substantially corresponds to an inner diameter of the receiving cavity defined by the inner wall (82) of the pot-shaped member.

4. A percussion tool according to claim 1, wherein the elastic ring (83) has a substantially elliptical cross-section, with a larger diameter extending parallel to the operational direction of the percussion tool.

5. A percussion tool according to claim 1, wherein the stop disc (86) has, at a front region thereof a conical, at least partially circumferentially extending stop shoulder (87) which widens in the operational direction and cooperates with the stop surface of (92) of the header (9).

* * * * *